US006859131B2

(12) United States Patent
Stanek et al.

(10) Patent No.: US 6,859,131 B2
(45) Date of Patent: Feb. 22, 2005

(54) DIAGNOSTIC BLOWN FUSE INDICATOR

(76) Inventors: Dan Stanek, 2954 N. River Walk Dr., Chicago, IL (US) 60618; John Kennedy, 725 Lakeshore Dr., Tuscola, IL (US) 61953; Lawrence Mark Klinger, 17 Country Club La., Arcola, IL (US) 61910

( * ) Notice: Subject to any disclaimer, the term of this patent is extended or adjusted under 35 U.S.C. 154(b) by 0 days.

(21) Appl. No.: 09/864,972

(22) Filed: May 25, 2001

(65) Prior Publication Data

US 2002/0175800 A1 Nov. 28, 2002

(51) Int. Cl.[7] ..... H01H 85/30; H01H 85/32

(52) U.S. Cl. ..... 337/206; 337/242; 337/266; 324/550

(58) Field of Search ..... 337/206, 241, 337/242, 245, 265, 266; 439/490, 491, 622; 324/507, 550, 691; 340/638, 639; 361/835; 81/3.8; 116/202

(56) References Cited

U.S. PATENT DOCUMENTS

| | | | | | |
|---|---|---|---|---|---|
| 737,280 | A | * | 8/1903 | Sachs | 337/243 |
| 2,164,658 | A | * | 7/1939 | Lyon | 337/242 |
| 2,206,784 | A | * | 7/1940 | Linton | 337/242 |
| 2,794,095 | A | * | 5/1957 | Kozacka | 337/219 |
| 2,809,254 | A | * | 10/1957 | Edsall | 337/158 |
| 3,047,695 | A | * | 7/1962 | Borys | 337/187 |
| 3,116,390 | A | * | 12/1963 | Goody et al. | 337/296 |
| 3,253,104 | A | * | 5/1966 | Fister | 337/166 |
| 3,453,580 | A | * | 7/1969 | Withers | 337/164 |
| 3,585,555 | A | * | 6/1971 | Yamada | 337/187 |
| 3,678,430 | A | * | 7/1972 | Gaia | 337/159 |
| 3,721,936 | A | * | 3/1973 | Belcher | 337/241 |
| 3,729,656 | A | * | 4/1973 | Luquain | 340/638 |
| 4,035,754 | A | * | 7/1977 | Kleinbohl | 337/206 |
| 4,058,784 | A | * | 11/1977 | Gaia | 337/164 |
| 4,156,225 | A | * | 5/1979 | Cuzzone | 337/241 |
| 4,308,515 | A | * | 12/1981 | Rooney et al. | 337/162 |
| 4,404,536 | A | * | 9/1983 | Still | 337/201 |
| 4,484,185 | A | * | 11/1984 | Graves | 174/66 |
| 4,527,143 | A | * | 7/1985 | Thienel | 337/242 |
| 4,641,120 | A | | 2/1987 | Bonfig et al. | |
| 4,760,367 | A | * | 7/1988 | Williams | 337/241 |
| 4,782,317 | A | * | 11/1988 | Thwaites | 337/165 |
| 5,001,451 | A | * | 3/1991 | Morrill, Jr. et al. | 174/52.3 |
| 5,032,946 | A | * | 7/1991 | Misencik et al. | 361/118 |
| 5,111,177 | A | | 5/1992 | Krueger et al. | |
| 5,113,169 | A | * | 5/1992 | Ruehl et al. | 337/265 |
| 5,343,185 | A | * | 8/1994 | Mosesian et al. | 337/163 |
| 5,345,210 | A | | 9/1994 | Swensen et al. | |
| 5,781,095 | A | | 7/1998 | Dietsch et al. | |
| 5,821,849 | A | | 10/1998 | Dietsch et al. | |
| 5,841,337 | A | | 11/1998 | Douglass | |
| 5,936,508 | A | | 8/1999 | Parker | |
| 5,994,993 | A | | 11/1999 | Castonguay, Jr. et al. | |

* cited by examiner

*Primary Examiner*—Anatoly Vortman
(74) *Attorney, Agent, or Firm*—Bell, Boyd & Lloyd

(57) ABSTRACT

The present invention provides a blown fuse indicator. More specifically, the present invention provides a blown fuse indicator adapted for use with multiple element fuses, which provides a perceivable distinction between a blown fuse due to a current overload and a blown fuse due to a short circuit. To this end, in one embodiment of the present invention, a diagnostic blown fuse indicator is provided for a fuse having both a short circuit element and a current overload element. The indicator includes a short circuit indicator in electrical communication with the short circuit element, wherein the short circuit indicator provides visual indication of a short circuit condition. The indicator also includes a current overload indicator in electrical communication with the current overload element, wherein the current overload indicator provides visual indication of an overload condition.

10 Claims, 3 Drawing Sheets

DIAGNOSTIC BLOWN FUSE INDICATOR

BACKGROUND OF THE INVENTION

1. Field of the Invention

The present invention relates, generally, to fuses. More particularly, the present invention relates to fuses having indicators that visually change when the fuse blows.

2. Description of the Prior Art

Known fuses exist that provide dual elements, so that the fuses blow if a short circuit occurs or if a current overload condition occurs. One example of such a fuse includes a short circuit element in series with a current overload or time delay element. The combination of fuse elements electrically communicates with a pair of terminals, which respectively electrically communicate with a pair of electrically conductive rounded end caps. The end caps of the fuse typically snap-fit into well-known fuse clips.

The short circuit element typically has a number of rows of slots in the metal or copper element. These rows of slots are commonly called bridges. A single, longer slot in the metal element exists between two of the bridges. The open area of the longer slot plus the open areas of the nearby bridge slots create an area around the longer slot having the highest electrical resistance on the metal element. When a short circuit occurs, the fuse typically blows at this high resistance area. The longer slot is therefore preferably placed near the middle of the short circuit element, so that if an arc occurs when the fuse blows, the arc must travel a longer distance along the blown element pieces to reach the terminals. Since the short circuit element is typically copper or copper alloy, the short circuit element does not melt due to an overload of current running through the element for a period of time.

The current overload or time delay element typically consists of a metal or metal alloy, such as lead-tin solder, which melts and interrupts current flow when a predetermined overload current flows through the element for a given period of time. The current overload or time delay element does not include a single area of high electrical resistance and therefore does not blow, or open, upon a short circuit. In this manner, the dual element fuses protect electrical components in a circuit system both from short circuits and from drawing an overload or damaging amount of current.

Known fuses also exist that provide blown fuse indication. Some known fuses provide a spring loaded mechanism, wherein the blown fuse triggers a spring that moves a plunger to a more visible location. Other fuse indicators provide a circuit in parallel to the fuse element circuit, wherein a conductive, yet highly resistive substance connects a light emitting diode (LED) or lamp in parallel with the fuse element circuit. Normally, virtually all the current flows through the fuse circuit such that the little amount of current that does travel through the highly resistive substance does not illuminate the LED. When the fuse blows, the current is forced through the highly resistive substance, illuminates the LED and thereby provides blown fuse indication.

Littelfuse, Inc., the assignee of the present invention, provides a blown fuse indicator which has a clear or transparent plastic lens that makes an internal fluorescein coated indicator coil visible to an operator. The blown fuse indicator provides a circuit that is in parallel with a fuse element. The resistance of the indicator coil is substantially higher than the resistance through the fuse element, so that current normally travels through the fuse element. When the fuse element melts, the main circuit opens, and current shunts through the resistive indicator coil, causing the coil to heat up, which vaporizes the fluorescein into a colored gas. The colored gas collects on the interior of the transparent plastic lens and provides blown fuse indication.

Another type of blown fuse indicator includes a clear or transparent plastic lens that makes an internal ball of white "gun cotton" visible. Gun cotton ignites and disappears when subjected to flames, sparks or temperatures of about 280° F. (138° C.). An igniter wire, which is in parallel with a fuse element, runs through the gun cotton. A black background exists behind the gun cotton, which is normally not visible to the operator. When the fuse element melts, current shunts through the igniter wire, and the wire heats to a temperature above the ignition temperature of the gun cotton. The gun cotton bums away, exposing the black background and providing blown fuse indication.

A further type of blown fuse indicator includes a flexible label attached to the exterior of the fuse body. The label has a colored, conductive layer fixed to the outside of the fuse body, which is connected in parallel with a fuse element. A temperature responsive layer is fixed to the outside of the semi-conductive colored background and normally blocks the operator from seeing the background. The resistance in the conductive layer is substantially higher than that of the fuse element. In normal operation, most of the current runs through the fuse element, and the small amount of current that runs through the conductive layer does not produce enough heat to raise the temperature of the responsive layer above its transition temperature. If the current in the circuit exceeds the amperage permitted by the fuse element, the fuse blows and allows current to shunt though the conductive layer. The conductive layer heats the temperature responsive layer above its transition temperature, whereby the responsive layer changes to a generally transparent state and permits the colored, conductive layer to become visible.

Each of the known blown fuse indicators provides a visual response to a blown fuse. None of the indicators, however, differentiate between a short circuit failure or an overcurrent situation. The purpose of the indicators is to provide information to the operator. The known indicators disclose the status of the circuit; i.e., is the circuit drawing a safe amount of current or not. If a circuit blows, it is also desirable for an operator to know why, so that the operator can diagnose the problem rather than simply replace the fuse. The known indicators do not provide such a tool. A need therefore exists to provide a diagnostic blown fuse indicator, which is adapted to operate with a multiple element fuse, which provides information about the cause of a blown fuse.

SUMMARY OF THE INVENTION

The present invention provides a blown fuse indicator. More specifically, the present invention provides a blown fuse indicator adapted for use with multiple element fuses, which provides a perceivable distinction between a blown fuse due to a current overload and a blown fuse due to a short circuit.

To this end, in one embodiment of the present invention, a diagnostic blown fuse indicator is provided for a fuse having both a short circuit element and a current overload element. The indicator includes a short circuit indicator in electrical communication with the short circuit element, wherein the short circuit indicator provides visual indication of a short circuit condition. The indicator also includes a current overload indicator in electrical communication with the current overload element, wherein the current overload indicator provides visual indication of an overload condition.

In an embodiment, the blown fuse indicator includes a transparent lens secured to the fuse, wherein both the short circuit indicator and the current overload indicator are visible through the lens. In another embodiment, the blown fuse indicator includes a number of transparent lenses secured to the fuse, wherein each of the short circuit indicators and the current overload indicators is respectively visible through one of the plurality of lenses.

In an embodiment the short circuit indicator is coated with a chemical composition which vaporizes upon a short circuit condition. In an embodiment, the current overload indicator is coated with a chemical composition which vaporizes upon a current overload condition.

In an embodiment, the short circuit indicator includes gun cotton and an igniter wire in contact with the gun cotton. In an embodiment, the current overload indicator includes gun cotton and an igniter wire in contact with the gun cotton.

In an embodiment, the short circuit indicator includes a label external to the fuse having a conductive layer in contact with the fuse and a temperature responsive layer in contact with the conductive layer. In an embodiment, the current overload indicator includes a label external to the fuse having a conductive layer in contact with the fuse and a temperature responsive layer in contact with the conductive layer.

In an embodiment, the short circuit indicator includes a highly resistive substance electrically communicating with a light emitting diode. In an embodiment, the short circuit indicator includes a highly resistive substance electrically communicating with a light emitting diode.

In another embodiment of the present invention, a diagnostic blown fuse indicator is provided for a fuse having both a short circuit element and a current overload element. The indicator includes a short circuit indicator electrically communicating with a point between a high resistance area of the short circuit element and the current overload element. The indicator also includes a current overload indicator electrically communicating with a point between a high resistance area of the short circuit element and the current overload element.

In an embodiment the short circuit indicator electrically communicates in parallel with the short circuit element. In an embodiment, the current overload indicator electrically communicates in parallel with the current overload element. In an embodiment, the overload element electrically communicates in series with the short circuit element.

In an embodiment, the overload element includes a solder piece in electrical communication with the short circuit element. In an embodiment, the short circuit element defines a slot for creating the high resistance area.

In an embodiment, the short circuit indicator and the current overload indicator electrically communicate with an end cap of the fuse.

In an embodiment, the short circuit indicator includes gun cotton and an igniter wire in contact with the gun cotton. In an embodiment, the current overload indicator includes gun cotton and an igniter wire in contact with the gun cotton.

In an embodiment, the short circuit indicator includes a label external to the fuse having a conductive layer in contact with the fuse and a temperature responsive layer in contact with the conductive layer. In an embodiment, the current overload indicator includes a label external to the fuse having a conductive layer in contact with the fuse and a temperature responsive layer in contact with the conductive layer.

In a further embodiment of the present invention, a diagnostic blown fuse indicator is provided for a fuse having both a short circuit element and a current overload element. The indicator includes a short circuit indicator electrically communicating in parallel with the short circuit element, wherein the short circuit indicator is coated with a chemical composition that is adapted to vaporize after a short circuit occurs. The indicator also includes a current overload indicator electrically communicating in parallel with the current overload element, wherein the overload indicator is coated with a chemical composition that is adapted to vaporize after a current overload circuit occurs.

An advantage of the present invention is to provide a blown fuse indicator having diagnostic capabilities, such that the indicator provides a perceivable distinction between a blown fuse due to an overload and a blown fuse due to a short circuit.

Another advantage of the present invention is to provide a diagnostic blown fuse indicator that is adaptable for use with many existing blown fuse indication technologies.

Additional features and advantages of the present invention will be described in and apparent from the Detailed Description of the Preferred Embodiments and the Drawings.

DETAILED DESCRIPTION OF THE PREFERRED EMBODIMENTS

Figure 1:
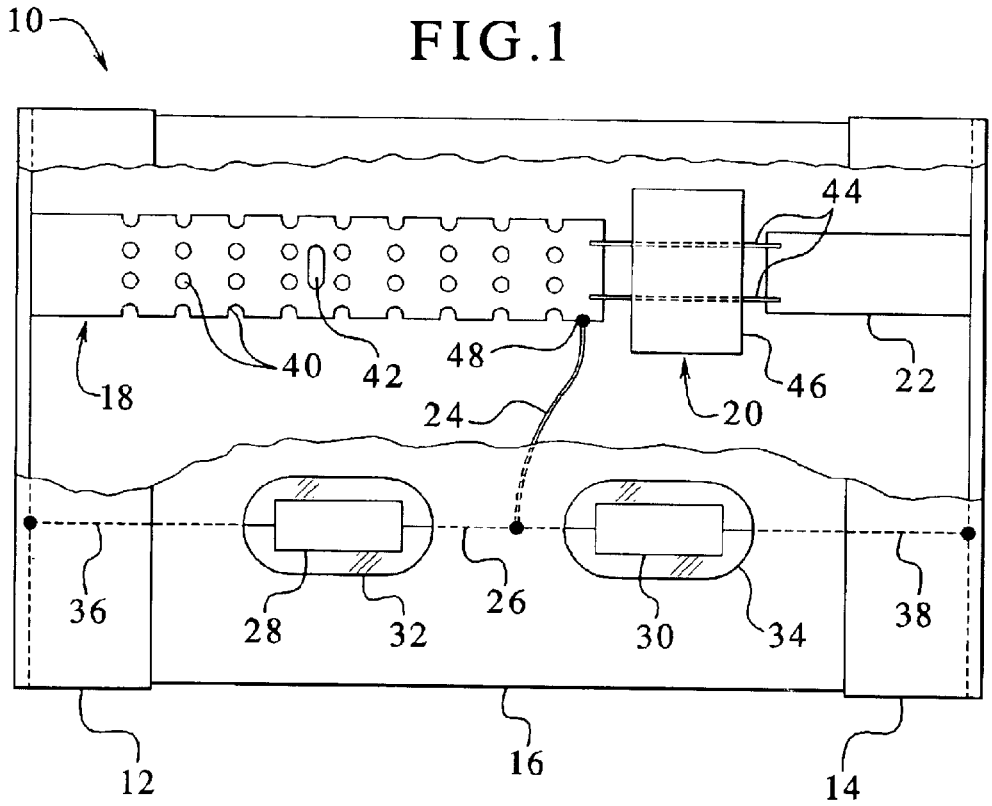
FIG. 1 is a schematic cutaway view of one embodiment of a fuse having the diagnostic blown fuse indicator of the present invention.

Referring now to the drawings and, in particular, to FIG. 1, a schematic cutaway of one embodiment of a fuse 10 having the diagnostic blown fuse indicator of the present invention is illustrated. The fuse 10 has a pair of cylindrical cup-shaped end caps 12 and 14, respectively. The end caps 12 and 14 are made of a suitably conductive material. A cylindrical body 16 is fixedly disposed between the end caps 12 and 14. The body 16 is made of a conventional insulating material. A portion of the end caps 12 and 14 and the body 16 has been cutaway for purposes of illustrating the dual element fuse circuit of the present invention.

The dual element fuse circuit includes a short circuit element 18 electrically communicating in series with a current overload element 20 (i.e., time delay element) and a heater element 22. For purposes of describing the present invention, it is sufficient to show the short circuit element 18 electrically communicating with the end cap 12 and the current overload element 20 electrically communicating with the end cap 14. It should be appreciated that the fuse 10 may contain other wires or terminals for fixing the schematically shown dual elements to the end caps 12, 14.

A shunting connector 24 electrically communicates with a splitting connector 26. The shunting connector 24 is illustrated as a single wire. However, the connector 24 is adaptable to have a number of spliced wires or include one or more terminals or terminals in combination with one or more wires. The splitting connector 26 is a wire, terminal or other suitable conducting device for electrically communicating with a short circuit blown fuse indicator 28 and a current overload blown fuse indicator 30. The portion of the fuse body 16 covering the indicators 28 and 30 is not cut away in order to illustrate the preferably clear or transparent plastic viewing lenses 32 and 34, which allow an operator to view the indicators 28 and 30, respectively.

The short circuit indicator 28 electrically communicates with the end cap 12 via end cap connector 36. The current overload indicator 30 electrically communicates with the end cap 14 via end cap connector 38. The end cap connectors 36 and 38 are likewise wires, terminals or other suitable conductive devices. It should be appreciated from the present schematic illustration that, via the shunting connector 24, the short circuit indicator 28 is connected in parallel with the short circuit fuse element 18. Further, the current overload indicator 30 is connected in parallel with the current overload fuse element 20.

In one embodiment, the short circuit element 18 is made of a conductive metal or conductive metal alloy and, in a preferred embodiment, is made of copper or a copper alloy. The element 18 defines a number of rows of slots 40. The rows of slots 40 are commonly called bridges. The element 18 also defines a single, longer slot 42 between two of the bridges. The open area of the longer slot 42 plus the open areas of the nearby bridge slots 40 create an area around the longer slot 42 having the highest electrical resistance on the short circuit element 18. When a short circuit occurs, the fuse typically blows or separates, thereby discontinuing current flow at the area around the longer slot 42. The longer slot 42 is therefore preferably placed near the middle of the short circuit element 18 to reduce the likelihood of damage from an arc.

In one embodiment, the current overload element 20, or time delay element, includes a number of preferably lead-tin solder bars 44 imbedded in an insulative housing 46. The insulative housing 46 in this embodiment is made of a resilient, compressible insulating material, such as an elastomer, e.g., silicone. When a normal amount of current flows through the solder bars 44, the solder bars heat up, but not to the melting temperature of the solder, which can be 500° F. (260° C.). When an overload condition occurs, the solder bars 44 become hotter. If the condition persists, the solder bars 44 reach their melting temperature, whereby the compressive housing 46 squeezes the melted solder through drainage holes in the housing (not illustrated) and interrupts current flow.

It should be appreciated that the solder bars 44 do not include single areas of high electrical resistance, which blow or separate open upon a short circuit. Furthermore, the melting temperature of the preferably copper or copper alloy short circuit element 18 is significantly higher (1985° F. (1085° C.) for copper and 2228° F. (1220° C.) for 55% Cu and 45% Ni) than for the lead-tin solder bars 44. Therefore, a persistent overload condition melts the solder element 20 long before melting the copper or copper alloy element 18.

The heater element 22 is preferably made of copper or copper alloy as is the short circuit element 18. The heater element 22 does not include or define slots. The heater element 22 does not therefore blow or become interrupted upon either a short circuit or a current overload. The heater element is bent or otherwise adapted to electrically communicate with each of the solder bars 44 of the current overload element 20.

The shunting connector 24 is also preferably made of copper or copper alloy, so that it does not degrade upon a current overload. In one embodiment, the shunting connector 24 is a copper or copper alloy wire that is spliced together with the splitting connector 26 (twist-on wire connector not illustrated), wherein the splitting connector 26 is also one or more copper or copper alloy wires. One or both of the shunting connector 24 and the splitting connector 26 are alternatively a solid copper or copper alloy piece having terminals or other apparatus for electrical attachment. That is, the shunting connector 24 is adaptable to be a solid copper or copper alloy piece, the splitting connector 26 is adaptable to be a solid piece and both are adaptable to form a single integral or interlocking piece.

Alternative embodiments for the short circuit indicator 28 and the current overload indicator 30 are described below. Typically, the indicators 28 and 30 are conductive, yet highly resistive relative to the fuse elements 18 and 20. In normal operation of the embodiment of FIG. 1, very little current flows through the end caps 12 and 14 to the indicators 28 and 30. That is, virtually all the current flows through the end caps 12 and 14 to the fuse elements 18 and 20.

In FIG. 1, the shunting connector 24 connects to a point 48 between the current overload element 20 and the highly probable point of short circuit breakage, which is the local area around the elongated slot 42 of the short circuit element 18. Therefore, upon a short in the circuit protected by the fuse 10, the element 18 breaks at or around the elongated slot 42, no current flows through the combination of fuse elements and all current is shunted through a circuit including the end cap 12, the end cap connector 36, the short circuit indicator 28, the splitting connector 26, the shunting connector 24, a blown portion of the short circuit indicator 18 at the point 48, the overload element 20, the heater element 22 and the end cap 14. Since the short circuit indicator 28 is typically highly resistive, heat builds up when current flows through the circuit just described. A properly designed blown fuse indicator of the present invention therefore enables the short circuit indicator 28 to visually change and self destruct before the solder bars 44 melt. Or, the resistance of the short circuit indicator 28 is designed such that the circuit does not reach the melting temperature of the solder.

With the shunting connector 24 connected to the point 48, upon a current overload in the circuit protected by the fuse 10, the solder bars 44 melt inside the compressive housing 20 and electrical communication ceases therein. Thereafter, no current flows through the combination of fuse elements and all current is shunted through a circuit including the end cap 12, the short circuit element 18, the shunting connector 24, the splitting connector 26, the overload indicator 30, the end cap connector 38 and the end cap 14. Heat built up due to current flowing through the overload indicator 30 does not cause the short circuit element 18 to blow. The indicator 30 preferably self destructs so that current does not continue to flow through the blown fuse 10.

Figure 2:
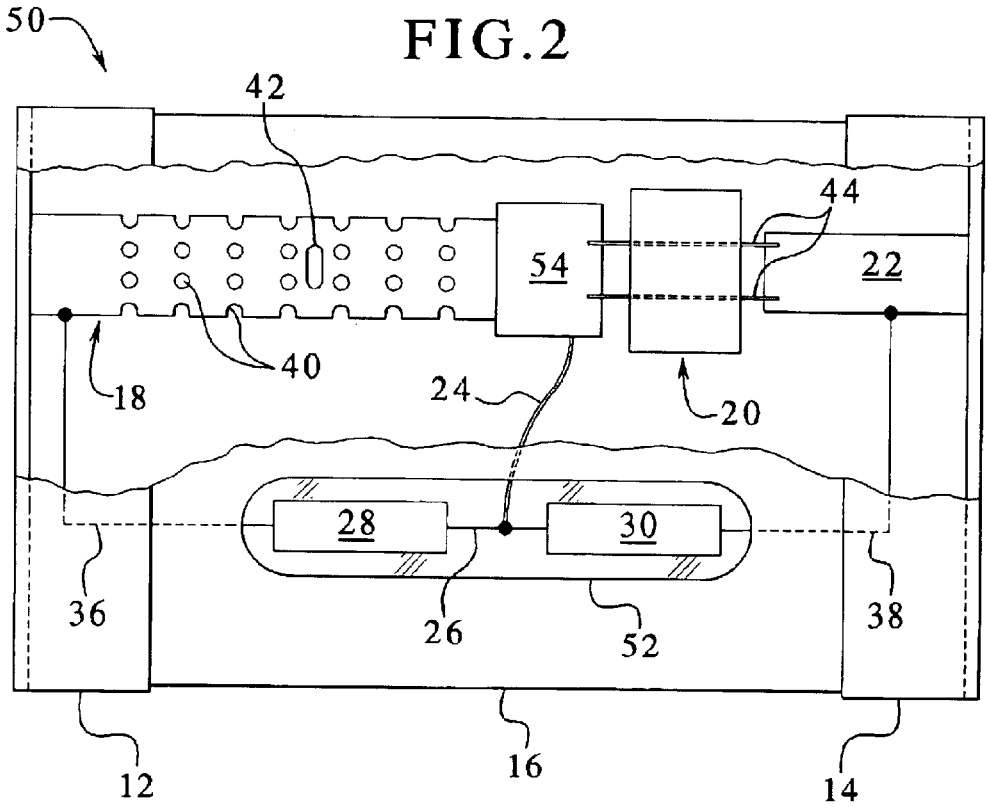
FIG. 2 is a schematic cutaway view of another embodiment of a fuse having the diagnostic blown fuse indicator of the present invention.

Referring now to FIG. 2, an alternative embodiment of the diagnostic blown fuse indicator of the present invention is illustrated by the fuse 50. The fuse 50 includes substantially the same components as described above and operates the same as described above. One difference is that the fuse 50 provides a single preferably plastic transparent viewing lens 52 for both the short circuit indicator and the current overload indicator 30. In implementing the present invention, the provision of one lens or two lenses may depend on the indicator embodiments described below.

A second difference is that the fuse 50 includes a second copper or copper alloy heater element 54 positioned between and electrically communicating with the short circuit element 18 and the current overload element 20. The heater element 54 does not include slots and, like the first heater element 22, does not degrade due to a short or current overload. The element 54 electrically communicates with the shunting connector 24 and connects to the shunting connector 24 through soldering, splicing, a quick disconnect or any other suitable technique.

A third difference is that the fuse 50 provides end cap connectors 36 and 38 that terminate at the short circuit element 18 and the heater element 22, respectively, instead of at the end caps 12 and 14. It should be appreciated in either case that the short circuit indicator 28 is in parallel electrical communication with the short circuit element 18. Further, in either case the current overload indicator 30 is in parallel electrical communication with the current overload element 20.

Figure 3:
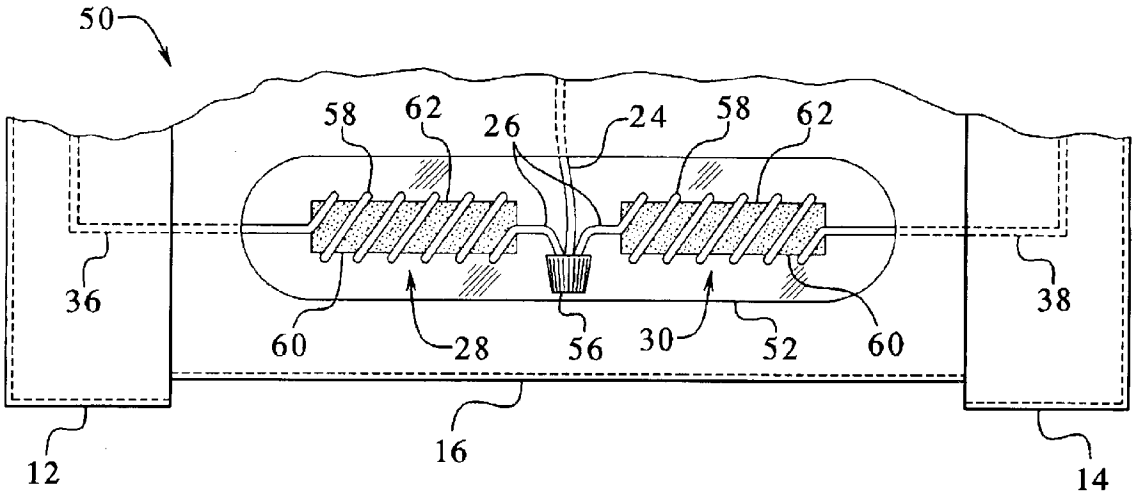
FIG. 3 is a schematic fragmentary view of one preferred embodiment for the dual indicators of the present invention.

Referring now to FIG. 3, one preferred dual indicator embodiment having a vaporizing chemical composition is schematically illustrated. The fuse 50, having the single transparent lens 52, further includes the end caps 12 and 14, the fuse body 16, the dual blown fuse indicators 28 and 30, which electrically communicate in parallel with their respective fuse elements via the end cap connectors 36 and 38, respectively. It should be appreciated that this preferred dual indicator embodiment is adaptable for the dual lens fuse 10. The splitting connector 26 electrically communicates with the shunting connector 24 via the twist-on wire connector 56.

Both the short circuit indicator 28 and the current overload indicator 30 include a thin coil 58 electrically communicating with an end cap connector and the splitting connector 26. The coil 58 is spirally wound about an insulator 60. The insulator 60 in one embodiment is a ceramic yam. The insulator 60 is dipped into a chemical composition 62 schematically indicated by the specks on the insulators 60. The chemical composition 62 in one embodiment includes fluorescein, calcium sulfate, a liquid of clear polyurethane coating and liquid paint thinner. The thin current carrying coil 58 in one embodiment is 0.0014 inch (0.035 mm) and is made of copper or copper alloy.

Under normal conditions, the ultra thin coils 58 do not draw enough current to vaporize the chemical composition 62. When either of the fuse elements blow open, the appropriate coil 58 sees the entire voltage of the circuit protected by the fuse 50. The coil 58 quickly heats up and causes the chemical composition 62 to vaporize and coat the lens 52 with a brown or black deposition. In a short period of time, the ultra thin coil 58 also bums up and blows open, so that no current flows through the blown fuse 50.

In the single lens embodiment, the deposition preferably localizes on the lens 52, near the effected indicator. For clarity, the manufacturer may wish to provide the dual lens disclosed in connection with the fuse 10 when employing this preferred form of indication. In one preferred embodiment of this form of indication, the fuse 10 provides a white plastic back piece (not illustrated) behind the lens or lenses to create a starker contrast between a non-blown fuse state and a blown fuse state. This embodiment further includes placing suitable indicia on the body 16, which suitably informs the operator as to which blown fuse indicator designates a short circuit and which blown fuse indicator designates a current overload.

Figure 4:
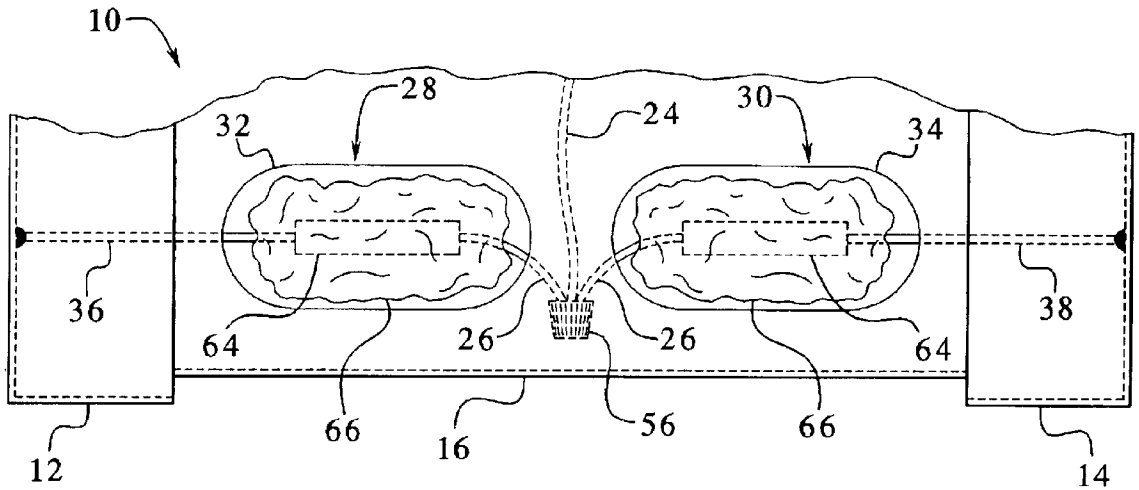
FIG. 4 is a schematic fragmentary view of one alternative embodiment for the dual indicators of the present invention.

Referring now to FIG. 4, one alternative dual indicator embodiment having a thin igniter wire 64 and gun cotton 66 is schematically illustrated. The fuse 10, having the dual lenses 32 and 34, further includes the end caps 12 and 14, the fuse body 16, the dual blown fuse indicators 28 and 30, which electrically communicate in parallel with their respective fuse elements via the end cap connectors 36 and 38, respectively. It should be appreciated that this alternative dual indicator embodiment is adaptable for the single lens fuse 50. The splitting connector 26 electrically communicates with the shunting connector 24 via the twist-on wire connector 56.

Both the short circuit indicator 28 and the current overload indicator 30 include an igniter wire 64 electrically communicating with an end cap connector and the splitting connector 26. The thin igniter wires 64 run through pieces of white gun cotton 66. The white gun cotton 66 substantially or fully fills the transparent lenses 32 and 34, so that the operator normally only sees the white of the gun cotton 66. The igniter wires 64 are therefore drawn in phantom indicating that they are disposed within the gun cotton 66.

Under normal conditions, the thin igniter wires 64 do not draw enough current to ignite the gun cotton 66. When either of the fuse elements blow open, the appropriate wire 64 sees the entire voltage of the circuit protected by the fuse 10. The thin wire 64 quickly heats up and melts, causing the gun cotton to disappear. In this alternative form of indication, the fuse 10 provides a black background (not illustrated) behind the gun cotton 66 to create a starker contrast between a non-blown fuse state and a blown fuse state. In this embodiment, the manufacture may wish to provide separate lenses to separate the gun cotton pieces, so that they do not ignite one another. This embodiment further includes placing suitable indicia on the body 16 to identify the purpose of each lens 32 and 34.

Figure 5:
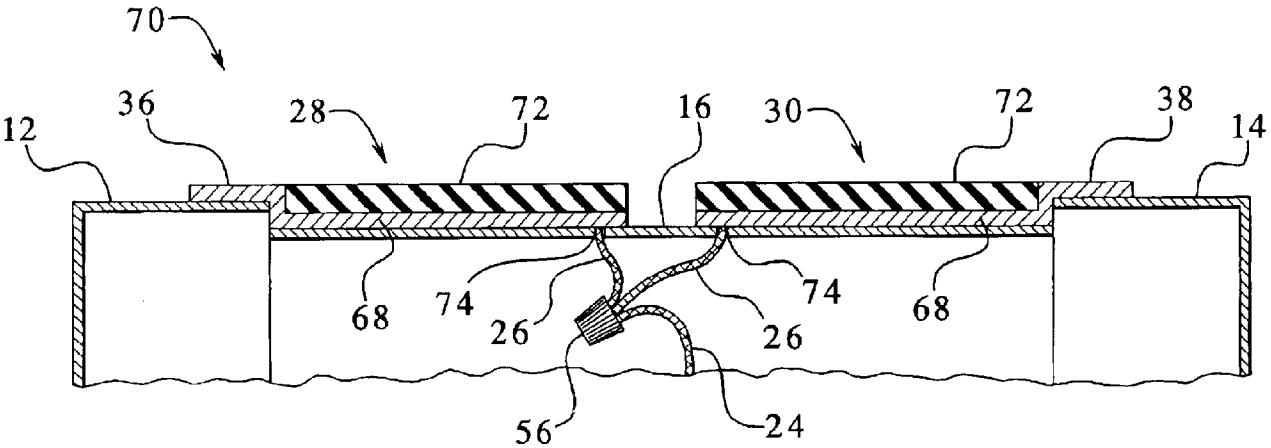
FIG. 5 is a schematic sectional view of another alternative embodiment for the dual indicators of the present invention.

Referring now to FIG. 5, another alternative dual indicator embodiment having an electrically conductive layer 68 and a temperature responsive layer 72 is schematically illustrated. A fuse 70, which is different than the fuses 10 and 50 disclosed above, includes the end caps 12 and 14 and the fuse body 16, but has no lens. The end cap connectors 36 and 38, reside outside the fuse body 16. The blown fuse indicators 28 and 30 in this embodiment include labels externally affixed to the fuse body 16.

The labels or fuse indicators 28 and 30 include an electrically conductive layer 68, which can be a conductive ink in combination with other materials such as wax, or alternatively, a conductive material such as aluminum. The conductive ink is disposed onto the body 16 through surface printing or coating, etc. The conductive aluminum in one embodiment is vacuum deposited onto the body 16. The temperature responsive layer 72 is adaptable to be a thermochromic material such as wax dispersed in a clear binder. The layer 72 is alternatively a clear polyester film. The temperature responsive layer 72 in one embodiment is applied to the conductive layer 68 through a suitable adhesive, such as a clear pressure sensitive adhesive.

The conductive layers 68 of the short circuit indicator 28 and the current overload indicator 30 electrically communicate with an end cap connector 36 and 38, respectively, as well as the splitting connector 26. The twist-on wire connector 56 splices the shunting connector 24 and the splitting connector 26 together. The end cap connectors 36 and 38 are preferably portions integral to the conductive layers 68, which are adapted to fit onto and adhere to the outer surfaces of the end caps 12 and 14, respectively. The splitting connector 26 electrically communicates with the indicators 28 and 30 through apertures 74 defined by the body 16.

The label indicators 28 and 30 have a resistance substantially higher than the fuse elements 18 and 20 (FIGS. 1 and 2), so that a small amount of current normally flows through the indicators 28 and 30. The normal amount of current is insufficient to cause the conductive layers 68 to heat the temperature responsive layers 72 above their transitions temperatures. When the temperature of the temperature responsive layers 72 is below the transition temperature, the layers 72 display a first color. When either of the fuse elements blow open, the appropriate electrically conductive layer 68 sees the entire voltage of the circuit protected by the fuse 70. The conductive layer 68 generates enough heat to elevate at least a portion of its associated temperature responsive layer 72 above the transition temperature. This transitional portion of the temperature responsive layer 72 changes to a second color.

In one embodiment, the first color of the temperature responsive layers 72 is white, while the second blown fuse color is transparent. In this embodiment, the electrically conductive layer 68 has a distinctive color, such as red, which becomes visible to the operator when the portion of the associated temperature responsive layer 72 transitions to clear or transparent. In another embodiment, the first color of the temperature responsive layers 72 is clear or transparent. When a portion of the temperature responsive layer 72 reaches its transition temperature, the clear color of the portion changes to a visible color.

Preferably, the conductive layer 68 bums up at some point after transitioning the temperature responsive layer 72, so that no current flows through the blown fuse 70. This embodiment further includes placing suitable indicia on the body 16, which informs the operator as to which label designates a short circuit and which label designates a current overload.

Figure 6:
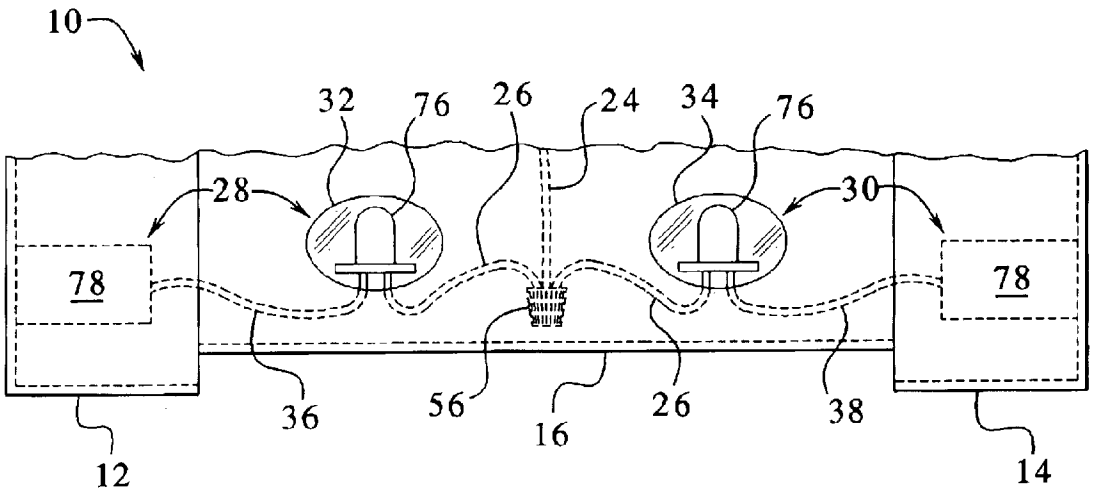
FIG. 6 is a schematic fragmentary view of a further alternative embodiment for the dual indicators of the present invention.

Referring now to FIG. 6, a further alternative dual indicator embodiment having a light emitting diode ("LED") 76 and a conductive yet highly resistive element 78 is schematically illustrated. The fuse 10, having the dual lenses 32 and 34, further includes the end caps 12 and 14, the fuse body 16, the dual blown fuse indicators 28 and 30, which electrically communicate in parallel with their respective fuse elements via the end cap connectors 36 and 38, respectively. It should be appreciated that this alternative dual indicator embodiment is adaptable for the single lens fuse 50. The splitting connector 26 electrically communicates with the shunting connector 24 via the twist-on wire connector 56.

Both the short circuit indicator 28 and the current overload indicator 30 include an LED 76 electrically communicating with an end cap connector and the splitting connector 26. In this implementation of the current embodiment, the end cap connectors 36 and 38 electrically connect the LED's 76 with conductive, yet highly resistive elements 78. The highly resistive elements 78 suitably attach to and electrically communicate with the end caps 12 and 14. The LED's 76 reside beneath the transparent lenses 32 and 34, so that the operator can see whether the LED is on or off. The conductive, yet highly resistive elements 78 are adaptable to be made from conductive plastic, or be a non-conductive material with a sprayed-on graphite layer or a metal layer deposited by evaporation.

Under normal conditions, the highly resistive elements 78 do not draw enough current to illuminate the LED's 76. When either of the fuse elements blow open, the appropriate resistive element 78 sees the entire voltage of the circuit protected by the fuse 10. The associated parallel indicator circuit draws enough current to illuminate the associated LED 76. In this alternative form of indication, the fuse 10 can provide a white or a black background (not illustrated) behind the LED's 76 to enable an operator to more readily see the illumination of the LED's. This embodiment requires a small amount of current to flow through the fuse 10 to maintain the indicators 28 and 30 after the fuse 10 has blown. This embodiment further includes placing suitable indicia on the body 16, which identifies the purpose of each LED 76.

Each of the above embodiments associated with FIGS. 3 through 6 provides two of the same type of blown fuse indicators 28 and 30. Other embodiments of the present invention include a combination of different methods of indication. For instance, one embodiment employs the preferred chemical vaporization method in combination with the gun powder method, wherein one designates a short circuit situation and one designates an overload situation. It should be appreciated that the present invention is adaptable to have any combination of the indicator methods disclosed herein.

It should be understood that various changes and modifications to the presently preferred embodiments described herein will be apparent to those skilled in the art. Such changes and modifications may be made without departing from the spirit and scope of the present invention and without diminishing its attendant advantages.

We claim as our invention:

1. A fuse having both a short circuit element and a current overload element, comprising:

a short circuit indicator electrically communicating in parallel with the short circuit element, wherein the short circuit indicator is coated with a chemical composition that is adapted to vaporize after a short circuit occurs;

a current overload indicator electrically communicating in parallel with the current overload element, wherein the overload indicator is coated with a chemical composition that is adapted to vaporize after a current overload occurs; and a single, rigid body that houses the short circuit element, current overload element, short circuit indicator and current overload indicator, wherein, (i) the body is fixed to conductive end caps that are exposed and configured to be fitted to mating connectors, (ii) the elements and indicators communicate electrically with the end caps, and (iii) the body defines at least one opening sized and shaped for a person to view both indicators located within.

2. The fuse of claim 1, which includes a viewing area that changes visually when the short circuit element opens and when the current overload element opens.

3. The fuse of claim 1, which includes a first viewing area that changes visually when the short circuit element opens and a second viewing area that changes visually when the current overload element opens.

4. The fuse of claim 1, wherein the current overload element is electrically communicating in series with the short circuit element.

5. A fuse having diagnostic blown fuse indication comprising:

a short circuit element having an area of higher electrical resistance between conductive ends, the area tending to open upon a short circuit;

a time delay element communicating electrically with one of the ends of the short circuit fuse element, the time delay element opening due to a current overload;

a short circuit indicator operating in parallel with the short circuit element;

a current overload indicator operating in parallel with the time delay element; and a single, rigid body that houses the short circuit element, time delay element, short circuit indicator and current overload indicator, wherein, (i) the body is fixed to conductive end caps that are exposed and configured to be fitted to mating connectors, (ii) the elements and indicators communicate electrically with the end caps, and (iii) the body defines at least one opening sized and shaped for a person to view both indicators located within.

6. The fuse of claim 5, wherein the short circuit indicator is electrically communicating in parallel with the short circuit element.

7. The fuse of claim 5, wherein the current overload indicator is electrically communicating in parallel with the time delay element.

8. The fuse of claim 5, wherein the time delay element is electrically communicating in series with the short circuit element.

9. The fuse of claim 5, at least one of the indicators includes gun cotton and an igniter wire in contact with the gun cotton.

10. The fuse of claim 5, wherein at least one of the indicators is coated with a chemical composition that vaporizes upon a fault condition.

* * * * *